US006848235B2

(12) United States Patent
Savage et al.

(10) Patent No.: US 6,848,235 B2
(45) Date of Patent: Feb. 1, 2005

(54) ADVERSE ENVIRONMENT FOIL CAP SEAL SYSTEM

(75) Inventors: Chester Savage, Irvine, CA (US); Dan Gudz, Santa Ana, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/364,116

(22) Filed: Feb. 10, 2003

(65) Prior Publication Data

US 2003/0182901 A1 Oct. 2, 2003

Related U.S. Application Data

(60) Provisional application No. 60/355,277, filed on Feb. 8, 2002.

(51) Int. Cl.[7] ..... B65B 43/40
(52) U.S. Cl. ..... 53/381.4; 53/109
(58) Field of Search ..... 53/81, 83, 85, 53/86, 109, 329.3, 381.4; 156/69

(56) References Cited

U.S. PATENT DOCUMENTS 3,928,109 A * 12/1975 Pollock et al. ..... 156/69
4,095,390 A * 6/1978 Knudsen ..... 156/69
4,363,338 A * 12/1982 Brown ..... 53/381.4
4,446,674 A * 5/1984 Inada ..... 53/109
4,458,734 A * 7/1984 Scholle et al. ..... 53/109
4,494,363 A * 1/1985 Rica et al. ..... 53/109
4,498,508 A * 2/1985 Scholle et al. ..... 53/109
5,108,356 A * 4/1992 Rickenbach ..... 493/353
5,432,437 A * 7/1995 Turner ..... 324/95
5,858,141 A * 1/1999 Repp et al. ..... 156/69
6,174,274 B1 * 1/2001 Hawkins et al. ..... 493/357
6,230,472 B1 * 5/2001 Stahlecker ..... 53/426

* cited by examiner

*Primary Examiner*—Louis Huynh
(74) *Attorney, Agent, or Firm*—King & Jovanovic, PLC

(57) ABSTRACT

Filling and sealing devices and methods of aseptically filling containers are disclosed herein. More specifically, the filling and sealing devices include a sterile filling chamber and an induction sealing device provided within the filling chamber. The induction sealing device is capable of withstanding and operating in the adverse conditions required to maintain the sterile environment within the filling chamber. Within the filling chamber, the container may be uncapped, filled, recapped, and foil sealed by an induction sealing process.

9 Claims, 6 Drawing Sheets

ADVERSE ENVIRONMENT FOIL CAP SEAL SYSTEM

CROSS REFERENCE TO RELATED APPLICATIONS

This application claims the benefit of U.S. Provisional Application No. 60/355,277, filed Feb. 8, 2002, and whose entire contents are hereby incorporated by reference.

BACKGROUND

Various filling devices have been developed to aseptically fill containers with perishable products such as, but not limited to, juices, dairy products, sauces, and purees. In order to maintain a long shelf-life of these perishable products, great care must be taken to minimize oxygen exposure and bacterial contamination during the filling process of the containers. Accordingly, various devices and methods have been developed to create and maintain aseptic filling conditions for perishable products. Generally, the devices used to aseptically fill a container may include the following steps: sterilizing the container; filling the container in a sterile environment; and sealing the filled container in the sterile environment. While the prior art aseptic filling systems have proven useful, more cost-effective and efficient aseptic filling systems are desirable.

SUMMARY

Embodiments of the filling and sealing device described herein can be adapted for filling and sealing a variety of packages such as, but not limited to, flexible bags, standup bags, flexible bags used in bag-in-box packages, semi-rigid containers, and rigid containers. Embodiments of the filling and sealing device utilize an induction sealing device to apply a foil seal liner onto the spout of the container within a sterile environment. By providing an induction sealing device within the sterile environment, there is no requirement to change the sequencing of the filling of the container with the exception of a short induction pulse for sealing the foil seal layer onto the container spout. Accordingly, this simplified process reduces the cost of foil sealing a container by eliminating a separate foil sealing station thereby resulting in a more efficient process. Additionally, the sealing system is compact enough so that it may be retro-fitted to other filling systems without major modifications.

According to one exemplary embodiment, the filling and sealing device is composed of an enclosed chamber and an induction sealing device. The enclosed chamber is composed of at least one wall, wherein one wall includes an opening in communication with the outside environment. The opening within the wall is sized to receive a spout of a container. The induction sealing device is positioned within the enclosed chamber so that a foil seal layer of cap liner may be affixed onto the spout of the container in a sterile environment. The induction sealing device is also designed to withstand temperatures ranging from approximately 150° F. to approximately 260° F., and pressures ranging from approximately 15 psi to approximately 20 psi.

According to another exemplary embodiment, the filling and sealing device is composed of an enclosed chamber having an upper plate, a lower plate, and at least one wall positioned between the upper plate and the lower plate. The upper plate includes a first opening in communication with a filling nozzle and the lower plate includes a second opening in communication with the outside environment and sized to receive a spout of a container. The enclosed chamber also includes clamping arms positioned over the second opening of the lower plate. The clamping arms have a first open position and a second closed position, wherein the clamping arms are sized to engage the spout of the container in the second closed position. Additionally, a movable capping arm is provided within the enclosed chamber. The capping arm is composed of a generally planar member having a first end and a second end, wherein a means for removing a cap from the spout and applying a cap to the spout is positioned at the first end of the capping arm. Also, an induction sealing device is coupled to the first end of the capping arm, wherein the induction sealing device is capable of sealing a foil seal onto the spout of the container.

Methods of filling and sealing a container with the various embodiments of the filling and sealing device are also described herein. According to one exemplary method, a container having a capped spout is secured within the filling chamber. The cap is then removed from the container spout. The container is subsequently filled with a flowable product within the filling chamber. The cap is then affixed onto the spout of the container. Thereafter, the foil seal that is positioned within the cap is inductively sealed onto the spout of the container by a short induction impulse. In another exemplary method, the recapping of the container and induction sealing of the foil seal layer are completed almost simultaneously. The filled and sealed container is then removed from the filling chamber.

DETAILED DESCRIPTION

Embodiments of the filling and sealing device described herein can be adapted to fill and seal a variety of packages such as, but not limited to flexible bags, flexible bags used in bag-in-box packages, semi-rigid containers, and rigid containers. More specifically, the system is adapted to fill and to foil seal a container in an aseptic environment. The filling system may be used to fill a container with perishable products such as, but not limited to, juices, dairy products, sauces, and purees.

Figure 1:
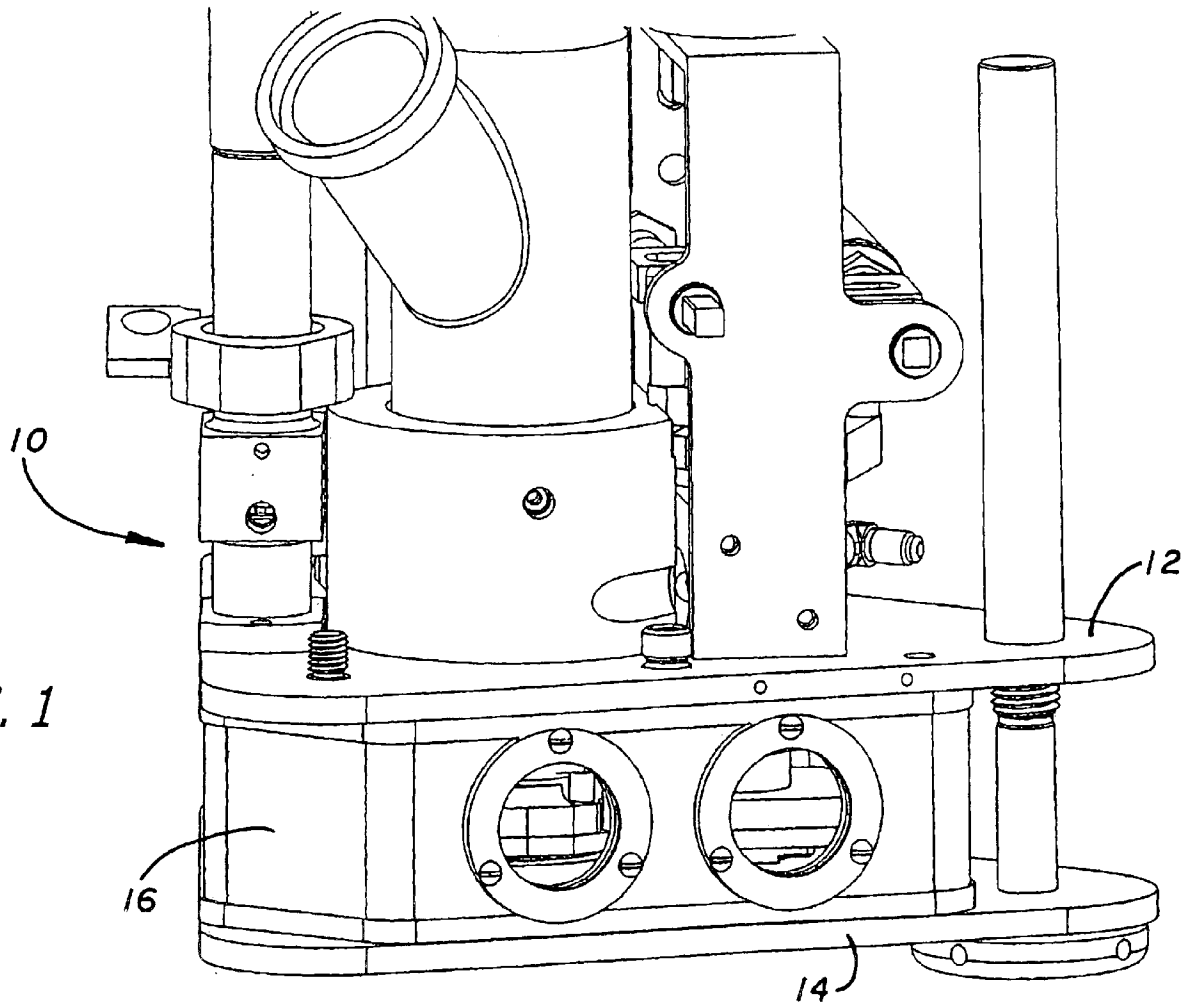
FIG. 1 is a perspective view of one exemplary embodiment of a filling chamber.
Figure 2:
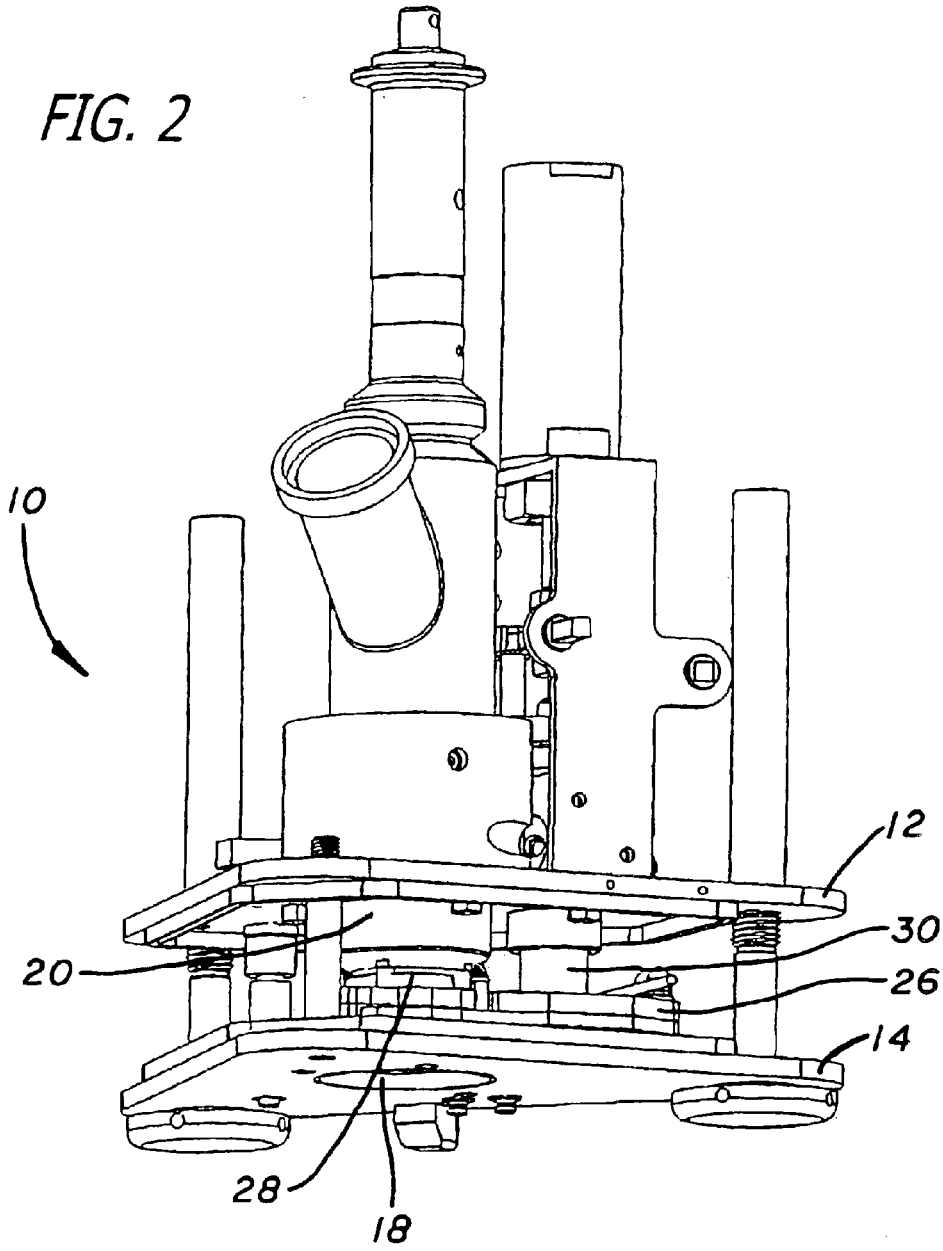
FIG. 2 is an alternate perspective view of FIG. 1.
Figure 3:
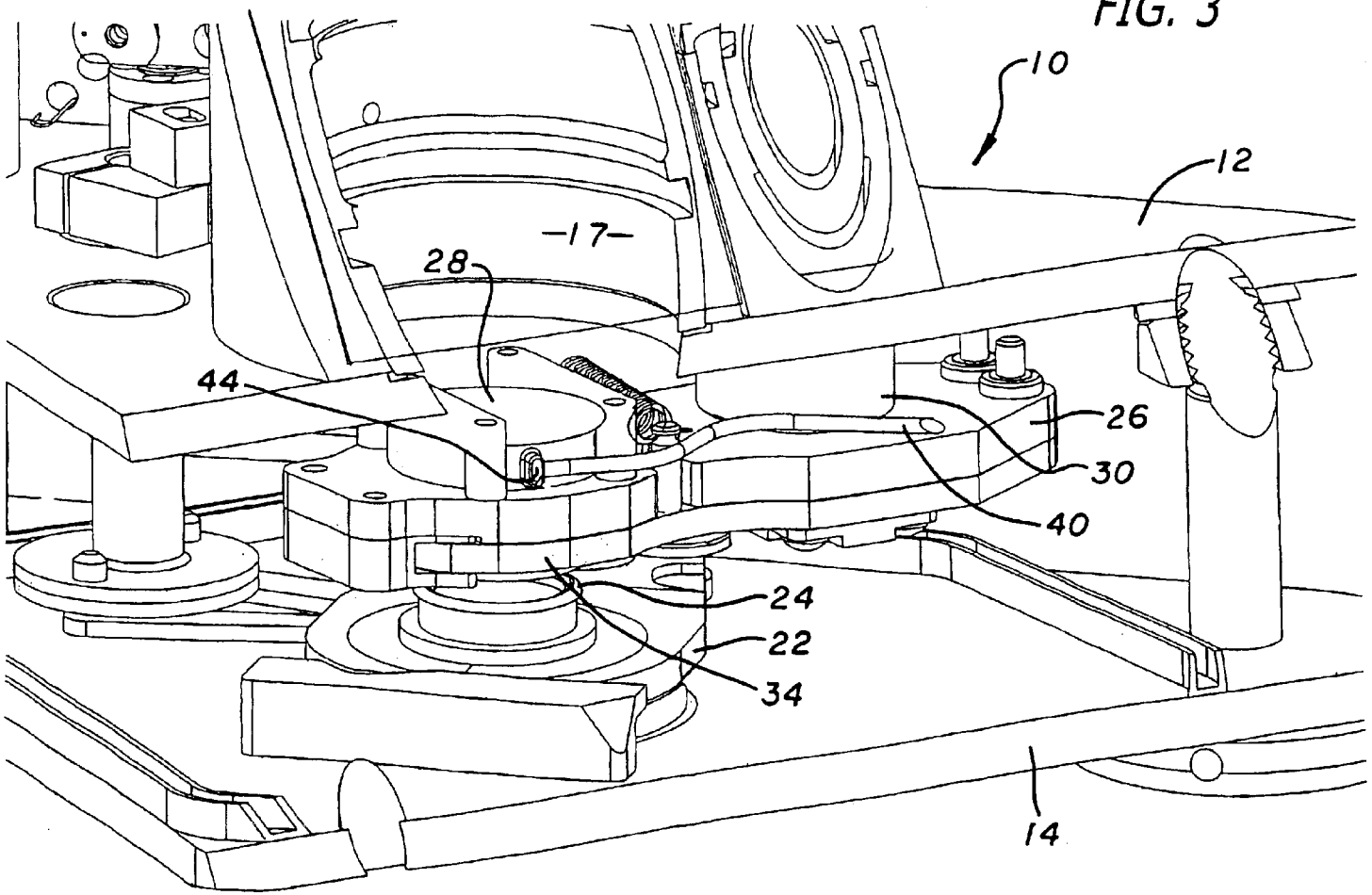
FIG. 3 is a perspective, cross-sectional view of FIG. 1.

According to one exemplary embodiment as depicted in FIG. 1, the filling and sealing system includes a filling station 10. As shown FIG. 1, the filling station 10 is an enclosed chamber defined by an upper plate 12, a lower plate 14, and at least one wall 16. The upper plate 12 is also provided with an opening 17 that is in communication with a filling nozzle 20 as shown in FIG. 3. The lower plate 14 is provided with an opening 18 sized to engage a container spout as shown in FIG. 2. Within the filling station 10, a sterile container may be opened, filled, and hermetically sealed in a substantially aseptic environment. The ability to fill and seal a container within the filling station enhances the device's efficiency while minimizing the costs of aseptically filling a container.

As shown in FIG. 3, clamping members 22 may be positioned within the filling station 10 chamber over the opening (not shown) of the lower plate 14. The clamping members 22 are generally planar members that are shaped to fit around the spout 24 or neck of the container to secure the spout within the chamber during the filling and sealing process. The individual clamping members 22 pivot with respect to one another between a first open position and a second closed position. In the first open position, the clamping members 22 are moved such that the spout or neck of the container may be inserted into or removed from the opening 18 of the lower plate 14. In a second closed position, the clamping members 22 are closed around the outer perimeter of the spout 24 thereby fixing the spout 24 within the filling chamber as shown in FIG. 3. The clamping members 22 also act to seal around the spout 24 thereby limiting the entry of ambient air into the filling chamber during the filling process.

Additionally, as shown in FIG. 2, the filling and sealing device also includes a capping arm 26 and a foil cap sealing device 28. The capping arm 26 is a generally planar member having a first end and a second end. At the first end of the capping arm 26 is a rod 30 extending from the surface of the capping arm 26. The rod 30 allows the capping arm 26 to be moved radially and/or longitudinally within the filling chamber 10. According to one exemplary embodiment, the rod 30 is attached to the surface of the capping arm 26. According to another exemplary embodiment, the rod 30 is integral with the capping arm 26. At the second end of the capping arm 26, there is an opening 32 sized to engage a container cap. A clamping means 34 is also positioned around the circumference of the opening. According to one exemplary embodiment, the clamping means 34 may be a pair of jaws that may engage the cap walls.

The capping arm 26 may be moved between a first position (FIG. 3) and a second position (not shown) within the filling chamber 10. As shown in FIG. 3, the capping arm 26 is positioned over the spout 24 in the first position. In this first position, the capping arm 26 may be lowered to remove the cap from or affix the cap to the spout 24. In the second position (not shown), the capping arm 26 is pivoted away from the container spout 24 thereby allowing the filling nozzle (not shown) to be placed in communication with the spout 24.

Figure 4:
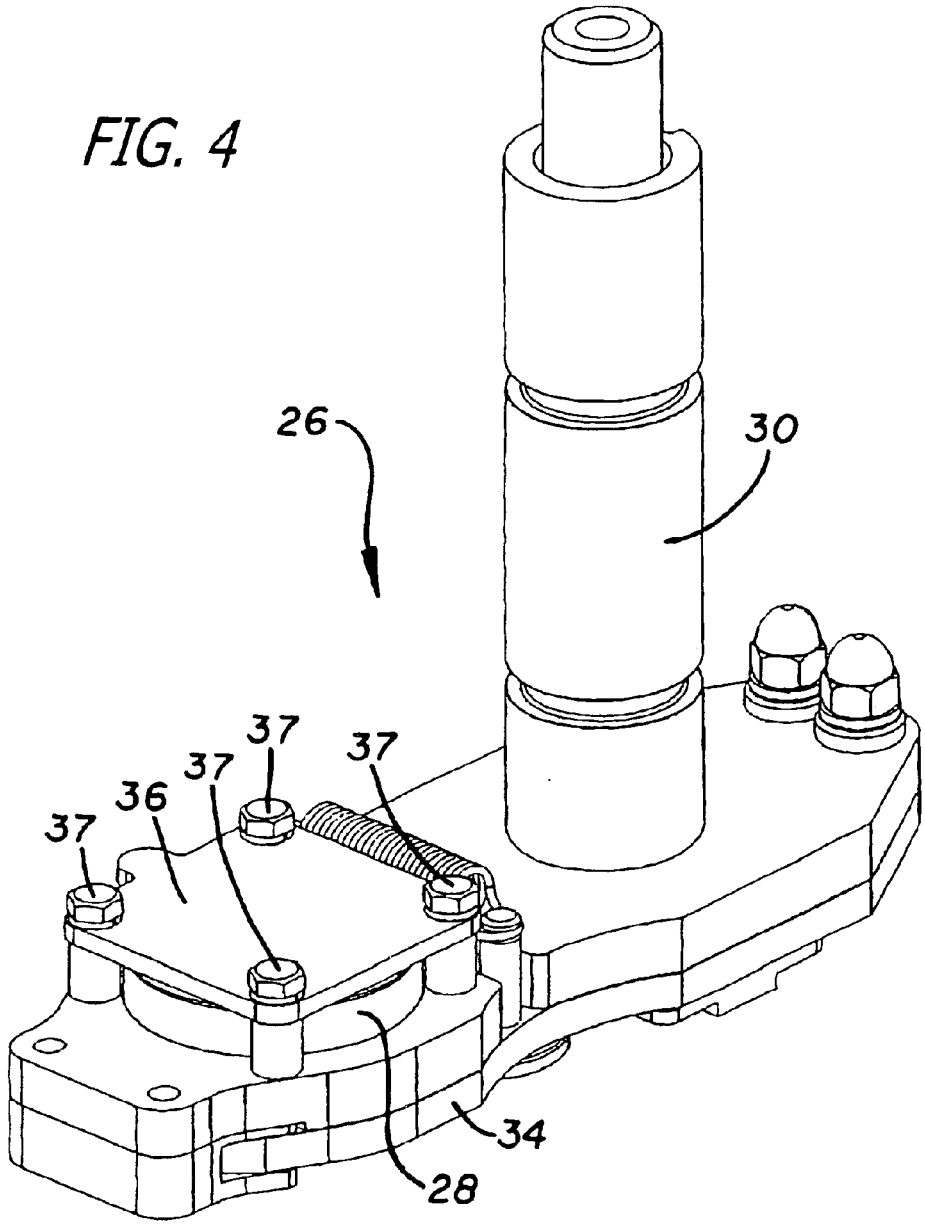
FIG. 4 is a perspective view of one exemplary embodiment of an induction sealing device mounted to one exemplary embodiment of a capping arm.

According to one exemplary embodiment, the sealing device 28 may be positioned over the opening 32 on the capping arm 26. As shown in FIG. 4, the sealing device 28 may be coupled to the capping arm 26 by a plate 36 and a plurality of screws 37. In alternate embodiments, the sealing device 28 may be coupled to the capping arm by braces or brackets. According to one exemplary embodiment, the sealing device 28 includes a main body 38 coupled to a power source (not shown) by a conduit 40. In one exemplary embodiment, the main body 38 may be a generally puck-shaped structure. The main body 38 contains a coil (not shown) that is capable of generating an electromagnetic field. According to one exemplary embodiment, the coil is encased within materials capable of withstanding temperatures of at least 260° F., pressures of at least 20 psi, and adverse chemicals. As those skilled in the art will appreciate, a plurality of materials may be utilized to form the main body of the sealing device.

Figure 5:
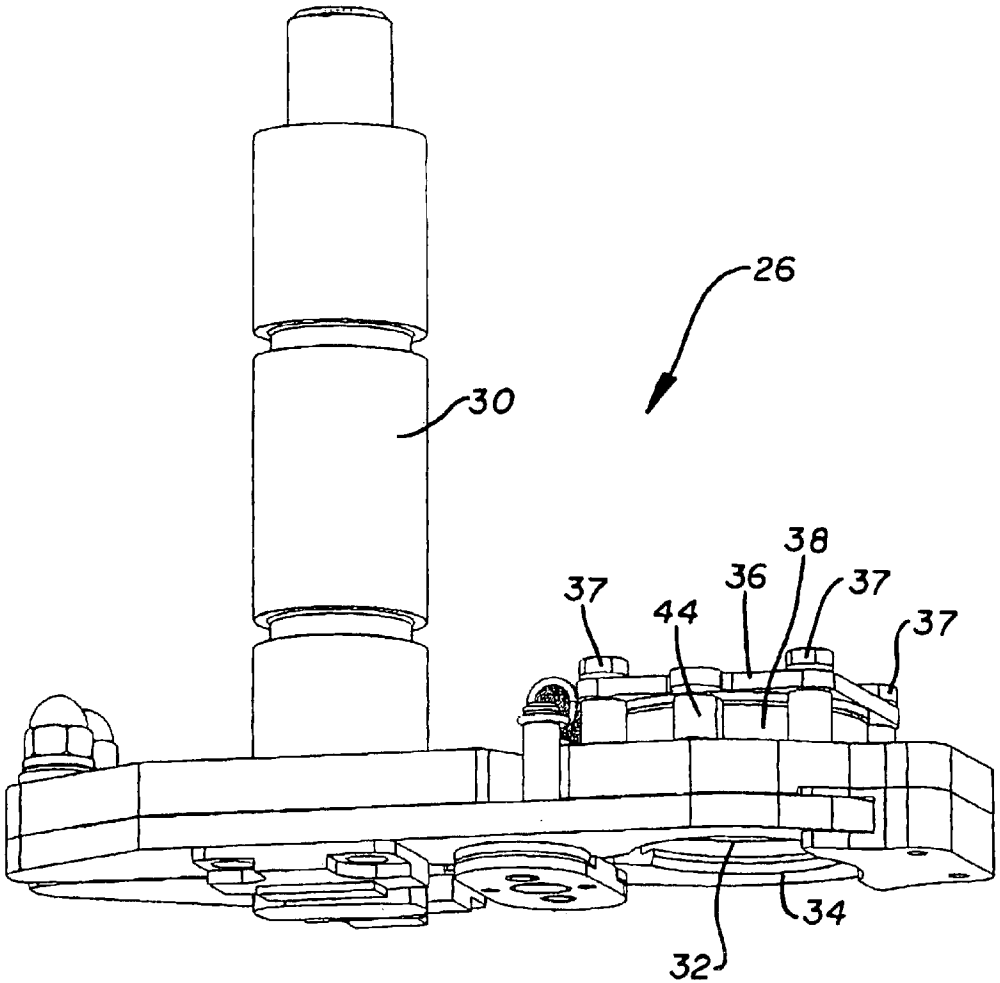
FIG. 5 is an alternate perspective view of FIG. 4.
Figure 8:
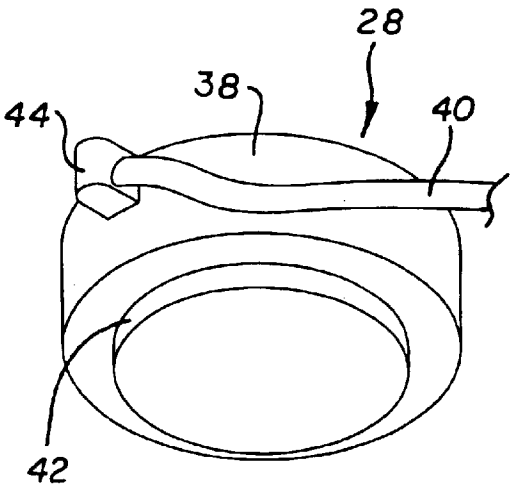
FIG. 8 is a perspective view of FIG. 6.
Figure 6:
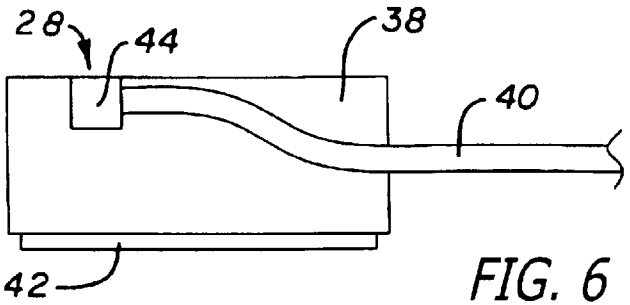
FIG. 6 is side view of one exemplary embodiment of an induction sealing device.
Figure 7:
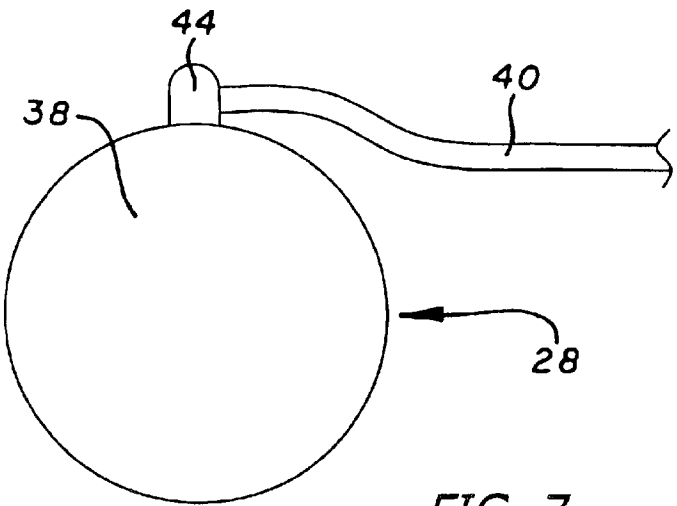
FIG. 7 is a top view of FIG. 6.

As shown in FIGS. 5–7, the main body 38 also may include an undercut 42 located on the bottom of the main body. The undercut 42 ensures that the sealing device 28 is properly seated within the opening 32 of the capping arm 26. Alternatively, in another exemplary embodiment, the main body may not be provided with an undercut. The main body 38 of the sealing device may also include a protuberance 44 that extends away from the main body 38 of the sealing device 28. As shown in FIGS. 5–7, the protuberance 44 is integral with the main body 38 of the sealing device 28. According to one exemplary embodiment, the conduit 40 may be coupled to the main body 38 via the protuberance 44 as shown in FIGS. 5–7. In an alternate embodiment, the conduit 40 may be directly coupled to the main body 38. As those skilled in the art will appreciate, the main body 38 of the sealing device may be shaped in a plurality of shapes and sizes. Additionally, as those skilled in the art will appreciate, the number, shape, and size of the coils contained with the main body may be varied to generate electromagnetic waves capable of securing a foil seal over the opening of a spout.

In an alternate exemplary embodiment, the sealing device 28 may be provided on a pivoting arm (not shown) distinct from the capping arm 26. According to one exemplary embodiment, the pivoting arm is a generally planar member that has the sealing device 28 coupled to one end of the arm. The arm is movable between a first position and a second position. In the first position, the sealing device is positioned over the capped container spout. In a second position, the sealing device is moved to a position away from the capped container spout. In other exemplary embodiments, the sealing device may be retro-fitted to other filling systems without major modifications. For instance, the sealing device may be fitted to filling apparatuses disclosed in U.S. Pat. No. 4,458,734 and U.S. Pat. No. 4,498,508, the entire contents of both patents which are hereby incorporated by reference.

Prior to use, the filling and sealing system is sterilized. According to one exemplary method, the filling chamber may be sterilized with culinary steam for at least 30 minutes at a pressure ranging from approximately 15 to approximately 20 psi and a temperature ranging from approximately 250° F. to approximately 260° F. During the filling process, the filling chamber is maintained at a temperature of approximately 150° F. to approximately 160° F. Additionally, the pressure of the sterile air supplied to the filling chamber is greater than the ambient pressure outside the filling chamber. That is, by maintaining a positive pressure within the filling chamber, air from the outside environment, which may contain bacteria, is prevented from entering the sterile filling chamber. Additionally, during the filling process, atomized chlorine spray or other sterilizing agents may be injected into the filling chamber to maintain the sterile environment.

Initially, a container having a capped neck or spout is advanced toward the opening of the lower plate of the filling chamber. The capped container has been previously sterilized thereby preventing bacterial contamination within the filling chamber when the cap is removed from the container. According to one exemplary embodiment, the cap is secured to the container spout by a snap-fit. According to another exemplary embodiment, the cap is secured to the container spout by a screw-fit relation. In either exemplary embodiment, a foil seal liner is contained within the base of the cap. The foil seal liner is composed of, at a minimum, a plastic liner layer and a foil layer. Other foil seal liner embodiments may also include a backing layer that may be composed of a chip board, foam, paper, or the like.

Once the capped spout has been positioned within the opening 18 of the filling chamber, the clamping members 22 secure the spout 24 within the filling chamber 10 and substantially seal the filling chamber as shown in FIG. 3. The capping arm 26 then pivots to a position over the capped spout. The capping arm 26 is then lowered to capture the cap on the spout. The capping arm 26 is then raised thereby removing the cap from the container spout. The capping arm 26 and the captured cap are then pivoted away from the spout 24.

The spout 24 is then placed in communication with the filling nozzle 20. In one exemplary method, the chamber 10 and the clamped spout 24 are raised to engage the filling nozzle 20. In another exemplary method, the filling nozzle 20 is lowered through the filling chamber 10 and placed in communication with the spout 24. Once the spout 24 and filling nozzle 20 are in communication with one another, the container is filled with the flowable product such as, but not limited to, juices, dairy products, sauces, and purees. After the container has been filled, the filling head 20 is withdrawn from the spout 24.

After the container is filled, the container may be recapped, and the foil seal liner may be affixed to the rim of the spout. More specifically, the capping arm 26 returns to a position above the spout 24. The capping arm 26 is then lowered thereby affixing the cap onto the spout 24. According to one exemplary method, when the cap is placed onto the spout 24, the foil seal in the cap may also bonded to the spout by an induction sealing process. Induction sealing is a process where electromagnetic waves generated by the sealing device 28 penetrate the cap and the foil layer of the foil seal liner. As the electromagnetic waves penetrate the foil layer, the electrical current flow in the layer generates sufficient heat to bond the plastic liner layer of the foil seal liner onto the rim of the spout. According to one exemplary method, the electromagnetic wave impulse may be applied to the foil seal layer for approximately 0.5 seconds. As those skilled in the art will appreciate, the intensity and duration of the electromagnetic wave impulse may be varied depending upon the composition and thickness of the materials that the electromagnetic waves have to penetrate to sufficiently heat the foil layer. After the induction sealing process has been completed, the clamping arms 22 release the spout 24 of the filled container. Subsequently, another empty container may then be advanced toward the opening on the filling chamber to be filled and sealed.

In another exemplary method, the capping arm 26 may exert pressure onto the cap and the foil seal to facilitate the bonding of the foil seal to the spout. More specifically, over-travel may be designed into the cap to permit the additional application of pressure onto the cap. As those skilled in the art will appreciate, by providing pressure onto the foil seal layer, the duration of the impulse required to induction seal the foil seal layer onto the spout 24 may be reduced. That is, as those skilled in the art will appreciate, the time required to induction seal the foil seal layer onto the spout may be reduced by varying the amount of heat applied to the foil seal layer or the pressure applied to the foil seal layer.

Moreover, the over-travel ensures that the cap is securely fastened to the spout 24 during the capping process. As those skilled in the art will appreciate that manufacturing variances may lead to a situation where the cap is not securely attached to the container. By providing the over-travel, these manufacturing variances are taken into consideration. Thus, the cap is securely fastened to the container and forms a good seal that prevents the entry of bacterial contaminants into the cap. In yet another exemplary method, the bonding of the foil seal to the spout 24 may be further facilitated by having the heat-seal layer made from materials compatible with the spout material.

In another exemplary method, the induction sealing process may be carried out after the cap has been affixed onto the spout by a separate pivoting arm provided within the filling chamber. That is, after the capping arm 26 has affixed the cap onto the spout 24, the capping arm 26 is pivoted away from the capped container. The pivoting arm is then positioned over the capped container. Power may then supplied to the sealing device which is provided on the pivoting arm to seal the foil seal layer onto the spout. After the induction sealing process has been completed, the clamping arms 22 release the spout 24 of the container and a subsequent container may then be advanced toward the opening 18 on the filling chamber 10.

Additional objects and advantages of the present invention will become readily apparent to those skilled in the art. Only preferred embodiments are shown and described, simply by way of illustration of the best mode contemplated of carrying out the invention. It is also contemplated that the present invention is capable of modification in various respects, all without departing from the scope and spirit of the present invention. Accordingly, the drawings and description are illustrative and not intended to be a limitation thereof.

What is claimed is:

1. A device for filling and sealing a container having a spout, a cap positioned on the spout and a foil seal positioned within the cap, comprising:

an enclosed chamber having the at least one wall, wherein one wall includes an opening in communication with the outside environment, the opening being sized to receive the spout of the container;

a filling nozzle positioned within the enclosed chamber, the filling nozzle selectively placeable in fluid communication with the spout of the container, to, in turn, fill the container with a fluid;

a capping arm positioned within the enclosed chamber, the capping arm including a means for clamping the cap and the foil seal positioned in the cap of a container having a spout received in the opening of the enclosed chamber; the capping arm capable of moving between a first position corresponding to a capping position to a second position corresponding to an uncapping position, and an induction sealing device positioned within the enclosed chamber, and coupled to the capping arm wherein the induction sealing device seals the foil seal onto the spout of the container through the cap, upon filling of the container by the filling nozzle and repositioning of the capping arm into the first position.

2. The device of claim 1 wherein the enclosed chamber further comprises clamping arms having a first open position and a second closed position, wherein the clamping arms are sized to engage the spout of the container in the second closed position; and wherein the capping arm is capable of removing the cap from the spout of the container.

3. The device of claim 2 wherein the induction sealing device comprises a main body coupled to a power source by a conduit, wherein the main body and the conduit are reinforced to withstand temperatures ranging from approximately 150° F. to approximately 260° F., and pressures ranging from approximately 15 psi to approximately 20 psi.

4. The device of claim 3 wherein the induction sealing device is coupled to a pivotable arm located within the enclosed chamber, the pivotable arm having a first position and a second position, wherein the induction sealing device is positioned above the cap in the first position.

5. The device of claim 1 wherein the capping arm comprises a generally planar member having a first end and a second end, wherein a means for removing the cap from the spout and applying the cap to the spout is positioned at the first end of the capping arm.

6. The device of claim 5 wherein the means for removing from the spout and applying the cap to the spout comprises at least one jaw adapted to engage the perimeter of the cap.

7. A device for filling and sealing a container having a spout, a cap positioned on the spout and a foil seal positioned within the cap, comprising:

an enclosed chamber having an upper plate, a lower plate, and at least one wall positioned between the upper plate and the lower plate, wherein the upper plate includes a first opening and the lower plate includes a second opening in communication with the outside environment and sized to receive the spout of the container;

a filling nozzle positioned within the enclosed chamber, the filling nozzle selectively placeable in fluid communication with the spout of the container through said first opening of the upper plate, to, in turn, fill the container with a fluid;

clamping arms positioned over the second opening of the lower plate, the clamping arms having a first open position and a second closed position, wherein the clamping arms are sized to engage the spout of the container in the second closed position;

a capping arm positioned within the enclosed chamber, the capping arm comprising a generally planar member having a first end and a second end, wherein a means for removing the cap from the spout and recapping the cap to the spout is positioned at the first end of the capping arm; and an induction sealing device coupled to the first end of the capping arm, wherein the induction sealing device seals the foil seal onto the spout of the container through the cap upon recapping of the cap by the capping arm.

8. The device of claim 7 wherein the induction sealing device comprises a main body coupled to a power source by a conduit, wherein the main body and the conduit are reinforced to withstand temperatures ranging from approximately 150° F. to approximately 260° F., and pressures ranging from approximately 15 psi to approximately 20 psi.

9. The device of claim 7 wherein the means for removing and applying the cap to the spout comprises at least one jaw adapted to engage the perimeter of the cap.

* * * * *

UNITED STATES PATENT AND TRADEMARK OFFICE

CERTIFICATE OF CORRECTION

PATENT NO. : 6,848,235 B2
DATED : February 1, 2005
INVENTOR(S) : Savage et al.

It is certified that error appears in the above-identified patent and that said Letters Patent is hereby corrected as shown below:

Column 2,
Line 56, after "As shown" insert -- in --.

Column 5,
Line 22, after "cap may also" insert -- be --.

Column 6,
Line 5, after "Power may then" insert -- be --.
Line 26, delete "the at least one wall," and substitute -- at least one wall, --.
Line 27, delete "one wall" and substitute -- the at least one wall --.

Signed and Sealed this

Twenty-eighth Day of June, 2005

JON W. DUDAS
*Director of the United States Patent and Trademark Office*